United States Patent [19]

Stubbe et al.

[11] Patent Number: 4,879,801

[45] Date of Patent: Nov. 14, 1989

[54] CATHODICALLY PROTECTED WATER HEATER

[75] Inventors: James S. Stubbe, Milwaukee; James L. Chevalier, Mequon; Edwin C. Pow, Menomonee Falls, all of Wis.

[73] Assignee: A. O. Smith Corporation, Milwaukee, Wis.

[21] Appl. No.: 343,957

[22] Filed: Apr. 26, 1989

Related U.S. Application Data

[60] Division of Ser. No. 200,468, May 31, 1988, Pat. No. 4,838,208, which is a division of Ser. No. 131,576, Dec. 11, 1987, Pat. No. 4,783,896, which is a continuation-in-part of Ser. No. 940,430, Dec. 11, 1986, abandoned.

[51] Int. Cl.[4] ..... B21D 53/00; B23P 15/26; B21K 29/00

[52] U.S. Cl. ..... 29/455.1; 29/458; 29/469; 228/184; 204/197; 122/13 R; 126/361

[58] Field of Search ..... 29/458, 460, 455 R, 29/455.1, 157 R; 204/197, 148; 228/183, 184; 122/13 R, 14, 16; 126/361

[56] References Cited

U.S. PATENT DOCUMENTS

| | | | |
|---|---|---|---|
| 2,229,526 | 1/1941 | Schabacker | 29/458 X |
| 2,428,526 | 10/1947 | Osterheld | 204/197 X |
| 2,490,978 | 12/1949 | Osterheld | 204/197 X |
| 2,566,138 | 8/1951 | Osterheld . | |
| 2,652,358 | 9/1953 | McFerran | 204/197 |
| 2,766,200 | 10/1956 | Kaufman | 204/197 |
| 2,777,194 | 1/1957 | Ashley | 29/458 |
| 2,866,742 | 12/1958 | Sutton | 204/197 |
| 2,993,617 | 7/1961 | Briggs . | |
| 3,268,989 | 8/1966 | Erwin et al. | 29/458 X |
| 4,109,684 | 8/1978 | Fernandez | 29/458 X |
| 4,113,600 | 9/1978 | Cook | 204/197 |
| 4,457,821 | 7/1984 | Sudrabin et al. | 204/197 X |

FOREIGN PATENT DOCUMENTS

| | | |
|---|---|---|
| 412423 | 6/1969 | Australia . |
| 425203 | 9/1969 | Australia . |
| 0156228 | 10/1985 | European Pat. Off. . |

*Primary Examiner*—Edward G. Favors

*Attorney, Agent, or Firm*—Niro, Scavone, Haller & Niro, Ltd.

[57] ABSTRACT

A cathodically protected water heater which eliminates the need of a conventional anode rod. The water heater tank includes a cylindrical shell enclosed by upper and lower heads and a flue which is mounted within openings in the lower and upper heads. The outer surface of the flue as well as the upper surface of the lower head is coated with a metal anodic to steel, and the metal coating on the flue extends continuously from the lower head to a location above the upper head. The remainder of the inner surface of the heater is also coated with the anodic metal. The anodic metal is applied in a sufficient thickness at least at the junction of the lower end of the peripheral flange of the upper head and the shell to bridge and seal the crevice opening which typically exists between the free end of the upper head flange and the shell wall. The coating over the crevice hydraulically seals the exterior weld between the upper head and shell from water contained in the heater and provides a corrosion barrier and anodic surface to contained water. Where welds are provided through the metal coating at the upper head/flue and shell/lower head junctions, the metal coating flows about the welds to also hydraulically seal them off from contained water and provide a corrosion barrier and anodic surface to contained water.

4 Claims, 4 Drawing Sheets

CATHODICALLY PROTECTED WATER HEATER

RELATED APPLICATION

This is a divisional of co-pending application Ser. No. 200,468 filed on May 31, 1988, now U.S. Pat. No. 4,838,208, which is a divisional of Ser. No. 131,576 filed on 12/11/87, now U.S. Pat. No. 4,783,896, which is a continuation-in-part of Ser. No. 940,430, filed on Dec. 11, 1986, abandoned.

BACKGROUND OF THE INVENTION

In a gas fired water heater, the burner is mounted beneath the lower head of the water storage tank and the waste gases of combustion are discharged through a flue that extends centrally through the tank. The hot waste gases passing upwardly through the flue increase the rate of heat transfer to the water contained within the tank.

To prevent corrosion of the steel tank, the inner surfaces of the tank, including the cylindrical sheel, the upper and lower heads and the flue, are normally glass coated. It has also been recognized in the prior art that other types of corrosion resistant materials such as zinc, aluminum and magnesium can be applied to the inner surfaces of the tank. Such coating procedures are for example described in U.S. Pat. Nos. 2,490,978 and 2,566,138. Methods of application have included hot dipping, spraying and painting. In addition, the prior art describes tanks which have been provided with non-corrosive liners such as aluminum as described in U.S. Pat. No. 2,993,617.

Further, a sacrificial anode is normally suspended in the upper head of the heater and projects downwardly into the tank. The anode is composed of a metal anodic to steel, such as magnesium, aluminum or zinc, and acts to cathodically protect any areas of the steel tank which may be exposed through defects in the glass coating or at the tank fittings.

The most conventional practice currently in fabricating a water heater is to initially weld the upper head to the upper end of the shell, with the inner surfaces of the preassembled shell and upper head then being coated with glass. As a separate operation, the flue is welded within an opening in the lower head and the outer surface of the flue as well as the upper surface of the lower head are similarly coated with glass.

Prior to firing the glass at an elevated temperature, the glass coating is brushed away from the inner surface of the annular flange bordering the opening in the upper head, as well as from the upper end of the flue so that when the flue is subsequently assembled within the opening in the upper head, a weld can be made directly from the steel upper head to the steel flue. Similarly, prior to firing, the glass coating along the lower edge of the shell and along the peripheral edge of the lower head is brushed away so that a weld can be made directly between the shell and the lower head. However, with such conventional practice, there is an area of exposed steel at the joint between the flue and the upper head as well as at the joint between the lower head and the shell.

Further, the upper heads of water heaters typically have a downwardly depending peripheral flange which is press fitted for assembly purposes within the upper end of the shell. In effecting such assembly, the upper head is forced through a sizing ring and disposed within the upper end of the shell so that the press fit is provided therebetween. Typically, the free end of the upper head flange flares inwardly slightly so that a crevice is created between the outer surface of the upper head flange at its lower extremeity and the side wall of the shell. Such crevices can be on the order of 0.015 inches or 15 mils at their opening. In the conventional practice of applying a glass coating to this area, it has been found that glass does not effectively flow around and cover sharp corners and does not tend to effectively fill or bridge and seal the aforesaid crevice. In addition, since glass is relatively inelastic, it tends to crack more easily than metallic coatings for example. Thus, in the conventional water heater using glass as an interior coating, or metallic coatings generally which do not effectively seal the aforesaid assembly welds, a substantial portion of the cathodic efficiency of the anode or anodic surface is expended in protecting the exposed steel at these joints. Not only is there an inefficient use of the anode when the assembly welds are not effectively sealed, there also is the drawback that no effective corrosion barrier has been provided and that no hydraulic seal has been provided with respect to the weld areas.

U.S. Pat. No. 4,113,600 discloses a method of minimizing the exposed steel at the joint between the flue and the flange on the upper head. In accordance with the aforementioned patent, an anodic metal is sprayed in the form of a small strip onto the exposed steel at the upper end of the flue which overlaps the glass coating on the flue. On assembly, the anodic metal coating is press fitted into engagement with the upper head to seal off exposed steel at the joint between the flue and the upper head. However, this arrangement has the drawback that manufacturing assembly tolerances on the order of plus or minus one-half inch can exist when assembling the subassembled flue/lower head with the subassembled shell/upper head whereby the vertical positioning of the press fitted metal coating in U.S. Pat. No. 4,113,600 may not be effective. Further, in this arrangement, with the remainder of the flue being glass coated, no substantial cathodic protection is provided by the flue.

Due to the conventional central disposition of a flue, prior art anodes have been necessarily mounted in an off-center position which reduce their cathodic effectiveness in certain areas of the tank. Put another way, the off-center location of a prior art anode results in it not being equidistant from the entire inner surface of the cylindrical shell whereby varying degress of cathodic protection are provided to the various tank areas.

Another problem arises from the presence of exposed steel in the area of mounting a prior art anode in the upper head. The conventional manner of mounting an anode is to weld a spud to the outer surface of the upper head bordering an opening therein. The upper end of the anode is then threaded within the spud and extends downwardly into the tank. However, the edge of the upper head bordering the opening, through which the anode extends, often is inadequately coated with glass, and a portion of the spud, which is normally formed of steel, is exposed through the opening. Thus the upper end of the anode can be prematurely consumed in protecting the edge of the upper head bordering the opening as well as in protecting the exposed spud. This results in a "necking down" condition of the upper end of the anode adjacent the upper head. Extreme "necking down" can result in the exposure of the steel core wire of the anode and the exposure of the steel wire will further decrease the effectiveness of the anode in protecting exposed steel surfaces of the tank.

Moreover, in the conventional cathodically protected water heater, the core wire is exposed at the lower end of the anode and the exposed end of the steel core wire will result in increased consumption of the lower end of the anode, causing the lower end of the anode to assume a bullet-like shape.

SUMMARY OF THE INVENTION

Accordingly, it is a general object of the invention to effectively protect the interior of a water heater from corrosion while providing such protection in an economically feasible manner.

Another object of the invention is to provide a metallic coating on the interior of the water heater surfaces which will function as a barrier coating in a corrosion sense, as a galvanic sacrificial surface in a cathodic protection sense whereby conventional separate cathodes can be eliminated, and as a hydraulic seal to protect the various joint welds of the heater from the contained water.

A further object of the present invention is to avoid the drawbacks associated with using glass as a corrosion protective coating wherein glass has more of a tendency to crack than does metal.

Another object of the invention is to effectively provide a barrier coating, cathodic surface and hydraulic seal across the typical crevice which exists between the upper head flange and interior wall of the heater shell by providing a metallic fillet with sufficient elasticity and thickness to bridge and seal the exposed edge of the flange and associated crevice.

Yet another object of the invention is to provide cathodic protection to the interior of the water heater in a more effective manner by maximizing the geometrical relationships between the cathodic surfaces (metal coated flue for example) and the heater tank surfaces being protected.

The invention, in a preferred embodiment, is directed to a cathodically protected, gas fired water heater which eliminates the need of the conventional anode. In accordance with the invention, the flue, the upper surface of the lower head and the lower surface and flanged opening of the upper head and the shell, are coated with a metal, such as aluminum, or alloys thereof, which is anodic to steel. The inner surface of the cylindrical shell as well as the lower surface of the upper head may also be coated with glass or other corrosion resistant coatings, such as organic resin coatings or inorganic silicate coatings. The glass coating, or metal coating as the case may be, extends to the lower edge of the shell as well as extending to the upper edge of the flange which borders the central opening in the upper head.

On assembly of the lower head and flue with the shell and upper head, the flue is inserted through the opening in the upper head and the anodic metal coating projects upwardly beyond the upper head. The upper edge of the flange bordering the opening is welded through the anodic metal coating directly to the flue. Similarly, the lower edge of the shell is welded through the anodic metal coating into the lower head. In both cases, the metal coating, such as aluminum, flows around the weld and effectively coats or seals the same with respect to the interior of the heater. In this manner, a barrier coating is provided with respect to the weld as well as a protective anodic surface with the weld being hydraulically sealed off from the tank interior.

With this construction, exposed steel areas at the joint between the flue and the upper head, as well as at the joint between the lower head and the shell are eliminated. By eliminating the exposed steel areas that normally occur in conventional practice, the overall efficiency of the cathodic protection system is increased.

The present invention is also directed to the welded joint between the upper head and the interior surface of the shell. Typically, a crevice exists between the outer surface of the upper head flange and the inner surface of the shell with the bottom of the crevice being defined by a press fit between the upper head and the shell. The opening of the crevice can be on the order of 15 mils or 0.015 inches. Of course, the lower edge of the upper head flange is bounded by sharp substantially right angle corners. The present invention comprehends the spraying of an aluminum coating about the corners of the lower edge of the flange and the crevice opening. Typically, the metal coating on the straight side wall of the shell, flue and heads may be on the order of 8 mils thick but in the area of the crevice between the upper head flange and shell, the metal coating thickness is intentionally increased which typically could be on the order of 15 mils nominal thickness. The increased thickness of the coating at the crevice can be imparted for example by a reduced rate of spray head movement or by use of a dwell when utilizing automatic spraying equipment. In this manner, the weld adjacent the base of the crevice is hydraulically sealed off while being provided with a barrier coating and protective cathodic surface.

The present invention is also directed to the welded joint between the lower portion of the flue and the lower head. The lower head and lower flue are first welded together as a subassembly which in turn is sprayed with an aluminum coating. The coating fully protects the weld in the same manner that it protects the adjoining surfaces of the flue and lower head.

The anodic metal coating on the flue replaces the conventional anode rod and is located centrally of the tank so that all surfaces of the cylindrical shell are equidistant from the anodic coating to provide more effective cathodic protection.

It is preferrred that the metal coating be applied through use of a thermal spraying operation which provides a textured surface that substantially increases the overall contact area of the anodic metal.

The invention may be utilized to eliminate the need of applying any glass coating and firing the glass coating, thereby providing a cost advantage over conventional methods.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
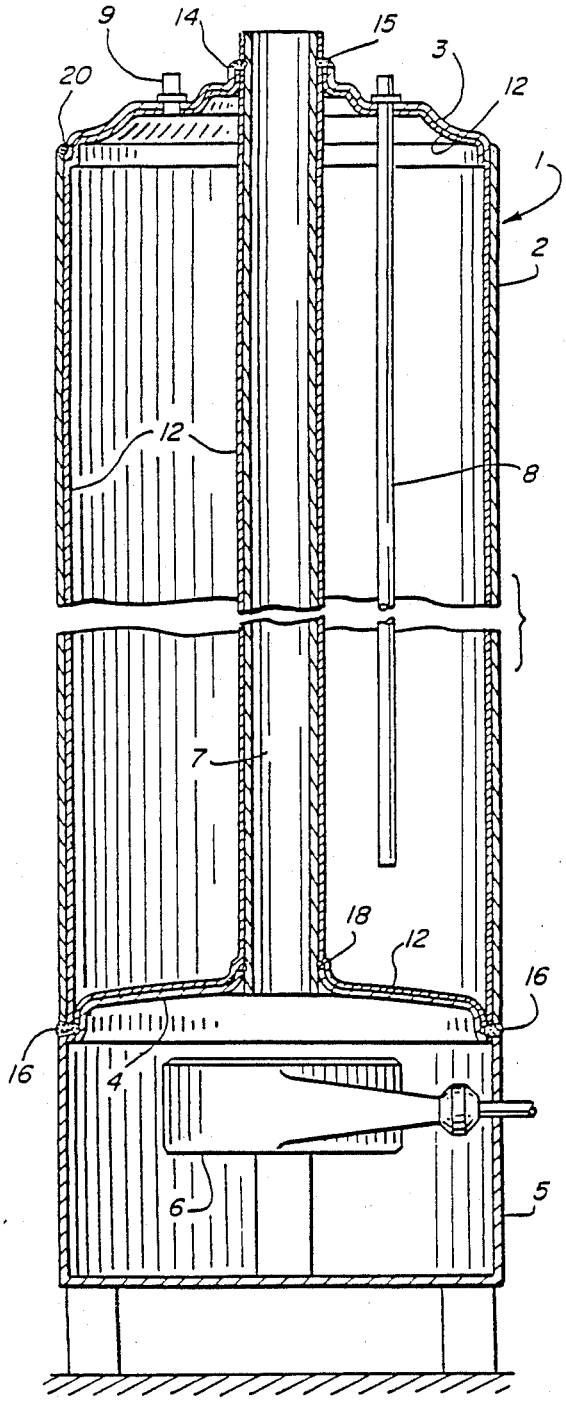
FIG. 1 is a vertical section of a water heater fabricated in accordance with the invention as including a metal coating anodic to steel sprayed onto all of the interior surfaces of the heater including the flue.

FIG. 1 shows a water heater tank 1 (similar components in the water heaters illustrated in FIGS. 6, 8 and 11 include the same numerical designation) composed of a generally cylindrical steel shell 2 having its ends enclosed by upper and lower steel heads 3 and 4. An annular supporting skirt 5 extends downwardly from the lower end of shell 2 and defines a compartment which houses a standard gas fired burner 6. The waste gases of combustion generated by burner 6 are conducted upwardly through shell 2 in a flue 7 which is mounted centrally of or coaxially with shell 2. In its final form, an outer casing, not shown, is spaced outwardly of shell 2 and a layer of insulating material is located between the shell and the casing.

Water to be heated is introduced into tank 1 through a dip tube 8 which is mounted within an opening in upper head 3 and heated water is withdrawn from the tank through an outlet 9 which is also mounted within an opening in upper head 3.

In accordance with one embodiment of the invention, a coating 12 of a metal anodic to steel, such as aluminum, magnesium, zinc or alloys thereof, is applied to the outer surface of flue 7 and to the upper surface of lower head 4 after subassembly of those components. In the FIGS. 1–5 embodiment, a further coating 12 of an anodic metal is applied to the inner surface of the upper head 3 and shell 2 after subassembly of those components. The subassembled lower head/flue is then assembled with the subassembled upper head/shell assume the configuration shown in FIG. 1. In addition, the skirt 5 is welded to the lower edge of shell 2 concurrently with the welding of shell 2 through coating 12 on the lower head 4 into head 4 as will be more specifically described with respect to FIG. 3.

Figure 2:
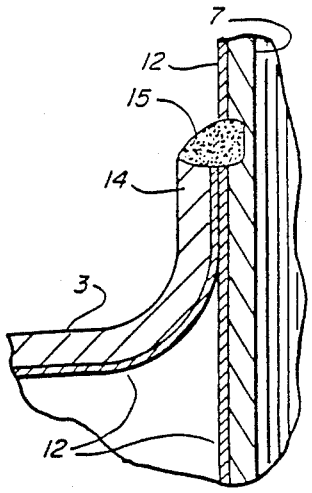
FIG. 2 is an enlarged vertical section of the welded attachment of the flue to the upper head illustrated in FIG. 1.

As shown in detail in FIG. 2, flue 7 extends beyond the top of the upper head flange 14 as does the anodic metal coating 12. Prior to assembly of the flue within the opening of flange 14, their respectively adjacent surfaces have been thermally sprayed with the anodic metal coating such as aluminum. The sprayed aluminum has the advantage of providing a textured surface which increases the surface area in a cathodic protection sense, and to the extent it is consumed the surface has a corresponding sacrificial characteristic. The flange opening and flue are sized taking into account their respective coatings so that preferably a press fit exists between the flue and the flange. A weld 15 is then made at the top edge of flange 14 in such a manner as to flow through the coatings 12 into the base material of flue 7. In so doing, it has been found that the welding process causes the adjoining coatings 12 to flow about the weld 15 and to effectively coat and seal the weld from the interior of the tank. To the extent that the press fit between the coatings 12 does not hydraulically seal the weld area, the resulting flow of anodic metal about the weld hydraulically seals the same off from the tank interior and provides a corrosion barrier and anodic surface for the weld and associated structural components with respect to contained water.

Figure 3:
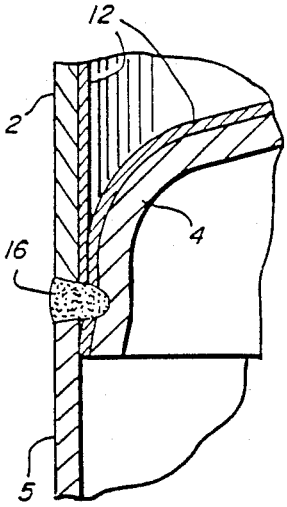
FIG. 3 is an enlarged vertical section showing the welded attachment of the lower head to the shell of the water heater illustrated in FIG. 1.

Similarly, FIG. 3 illustrates the weldment of the coated lower head to the shell in which the aluminum coating for example is caused to flow about weld 16 to hydraulically seal off the weld and provide a corrosion barrier as well as an anodic surface to contained water. Typically, the skirted housing 5 is concurrently welded to the bottom edge of shell 2, with the housing 5 enclosing the gas fired burner means 6.

Figure 4:
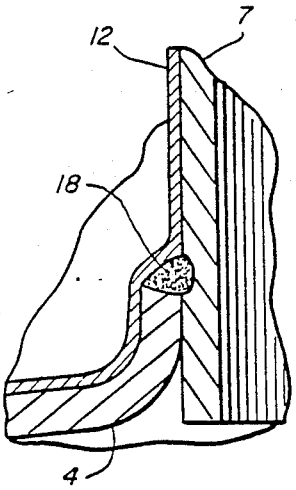
FIG. 4 is an enlarged vertical section of the welded attachment of the flue to the lower head of the water heater illustrated in FIG. 1.

Turning to FIG. 4, as mentioned, the lower head 4 is subassembled with flue 7. The subassembly is effected by means of weld 18 with the coating 12 imparted to the subassembly of the head 4 and flue 7. An uninterrupted protective anodic surface is provided while isolating weld 18 from contact with the contained water.

Figure 5:
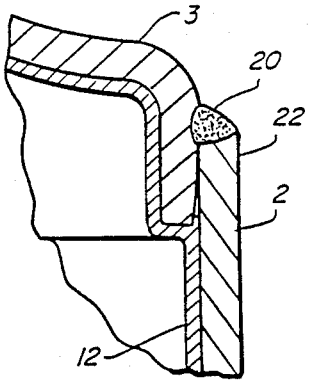
FIG. 5 is an enlarged vertical section of the welded attachment of the upper head to the shell of the water heater illustrated in FIG. 1.

As illustrated in FIG. 5, the upper head 3 is shown assembled within the upper end of shell 2. Typically, the upper head 3 is forced through a sizing ring when being placed within shell 2 which results in an expansion press fit against shell 2. This is in combination with any distortion which results from the placement of weld 20 on the top edge of shell 2 to the flange of head 3 causes a crevice 22 to be formed between the outer surface of the depending flange of head 3 and the inner surface of shell 2. The opening of crevice 22 at its mouth can be on the order of 15 mils. Although a press fit exists between the head and the shell, a water tight seal is not insured whereby weld 20, absent other appropriate hydraulic sealing, is exposed to the corrosive effects of the contained water. To the extent the press fit during assembly would tend to seal weld 20 from water contact during use, the hydraulic pressure in the tank tends to force shell 2 outwardly which tends to offset the press fit sealing effect.

The problem encountered with glass in this joint location involves the fact that the glass does not effectively cover the sharp corners of the upper head flange end surface nor does the glass tend to readily flow into the crevice or cover the sharp downward turn between the flange end surface and the side wall of the shell.

Also, glass does not have the same degree of elasticity as does sprayed aluminum for example, and therefore tends to crack in this area. To the extent tank interiors have been previously coated with various anodic metals, no particular attention has been given to effectively sealing such joint areas and more effectively providing cathodic protection.

In the area of crevice 22, the thickness of the coating needed to effectively bridge and seal the crevice 22 varies with the degree of crevice opening. As mentioned, it has been found that crevice openings range upwards of 15 mils, and in that case it has been found that a metal coating thickness (such as aluminum) on the order of 15 mils will dependably bridge and seal the crevice. It is to be noted that the straight wall surfaces on the shell for example can be thinner, on the order of 8 mils for example, depending on the expected service life anticipated for the unit. In terms of imparting a relatively greater thickness to the coating at the crevice area, it has been found that a reduced rate of spray head movement or a spray head dwell when using automatic spraying equipment can be used to give the relatively thicker coating at the crevice location as opposed to the shell side walls for example where a relatively thinner coating is acceptable.

Figure 6:
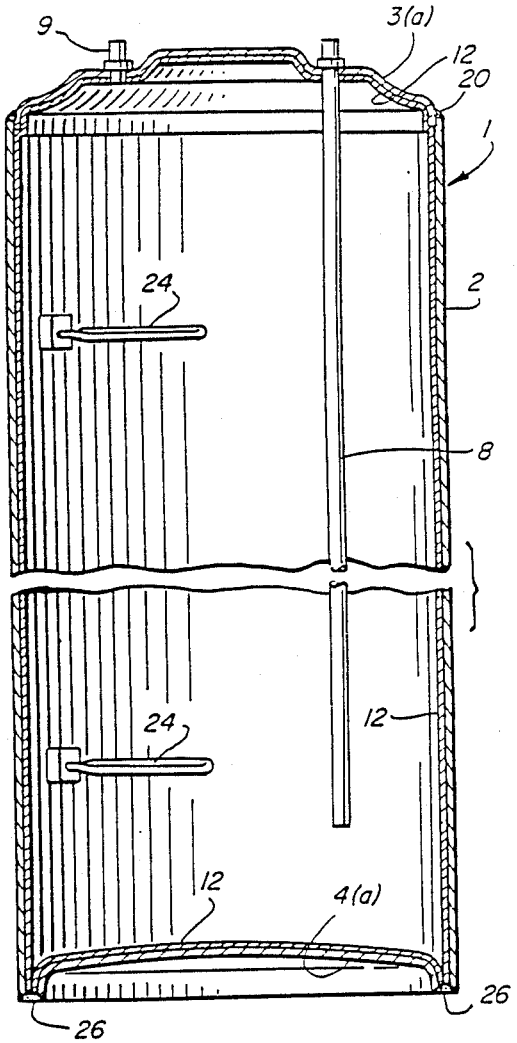
FIG. 6 is a vertical section of an electric water heater (no central flue) fabricated in accordance with the invention as including a srayed metallic coating anodic to steel on all of its interior surfaces.
Figure 7:
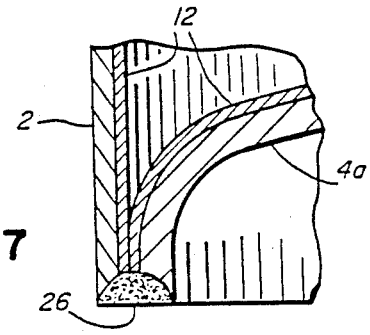
FIG. 7 is an enlarged vertical section of the welded attachment between the lower head and shell of the water heater illustrated in FIG. 6.

FIG. 6 illustrates a water heater similar to that illustrated in FIG. 1 except for the fact that it is energized electrically. Accordingly, heating elements 24 are provided for water heating purposes. The weld 20 between the head and shell is provided in the same manner and for the same reasons as described with respect to FIG. 5. Of course, there are no center flue considerations in the electric heater embodiment. In regard to the assembly of the lower head **4*a*, an anodic metal such as aluminum is spray coated to the upper surface or interior surface at 12 with respect the lower head 4*a*. That aluminum coating abuts the aluminum coating 12 on the side wall of shell 2 which flow together about weld 26. Weld 26 joins shell 2 to the lower head 4*a*. The hydraulic sealing and resulting corrosion barrier and cathodic protection described with respect to the shell/lower head joint in FIG. 3 is similarly provided to the joint illustrated in FIG. 7** for an electric hot water heater.

FIGS. 8–12 deal with an alternative embodiment of the present invention which includes a glass coating on the inner surfaces of the shell and upper head and an anodic metallic coating such as aluminum on the outer surface of the flue and inner surface of the upper head exposed to contained water.

Figure 8:
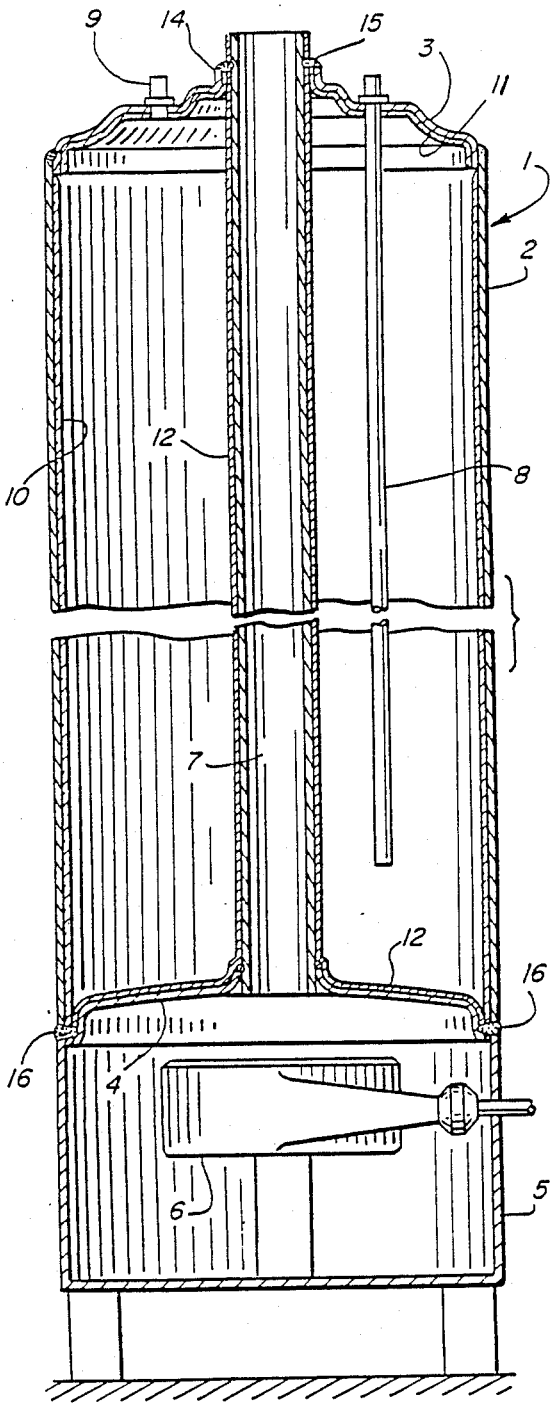
FIG. 8 is a vertical section of a gas fired water heater fabricated in accordance with the invention as including a glass coating on the interior of the upper head and shell and a metallic coating anodic to steel on the flue and interior surface of the lower head.

In fabricating this water heater, the peripheral flange of upper head 3 is again initially welded to the upper end of shell 2. The glass coatings 10 and 11 are then applied to the inner surface of the shell as well as to the lower surface of upper head 3, respectively, and the glass coating is then fired at an elevated temperature to provide a fused protective coating on the inner surfaces of the shell and upper head. As illustrated in FIG. 8, the glass coating 10 extends downwardly to the lower end of shell 2, and similarly the glass coating 11 on upper head 3 extends to the upper edge of the flange 14 bordering the central opening in the upper head and to the lower edge of the peripheral flange surrounding upper head 3.

The lower end of flue 7 is welded within an opening in lower head 3 and the outer surface of flue 7 as well as the upper surface of lower head 4 are then sprayed with the anodic metal to provide the coatings 12. The metal coating 12 extends continuously from the edge of the lower head to the upper end of the flue.

Figure 9:
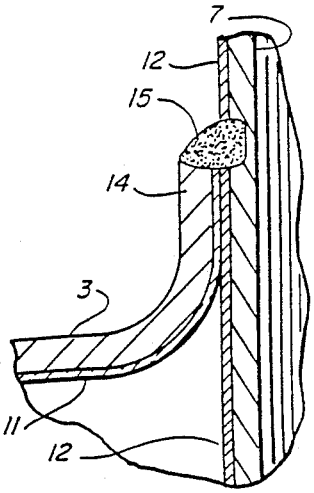
FIG. 9 is an enlarged vertical section showing the attachment of the flue to the upper head of the water heater illustrated in FIG. 8.

The subassembled lower head 4 and flue 7 are then assembled with the subassembled shell 2 and upper head 3, with the upper end of the flue being inserted through the opening bordered by flange 14. As shown in FIG. 9, the metal coating 12 extends upwardly to a location above the upper edge of the flange 14.

The upper edge of flange 14 is then welded, as indicated by 15, through the metal coating 12 directly to flue 7. Weld 16 connects the abutting ends of shell 2 and skirt 5 to the peripheral flange of lower head 4, as best seen in FIG. 10.

Figure 10:
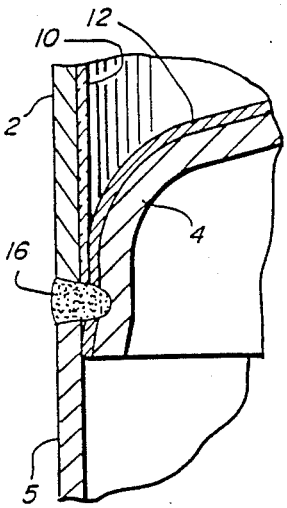
FIG. 10 is an enlarged vertical section of the welded attachment of the lower head and shell of the water heater illustrated in FIG. 8.

As shown in FIGS. 9 and 10, the glass coating and the anodic metal coating extend continuously through the joint between the flue 7 and the upper head 3, as well continuously through the joint between the lower head 4 and the shell 2, thereby eliminating any exposed steel at these joint areas. By eliminating exposed steel at these joints, the consumption of the anodic coating 12 is substantially reduced.

Figure 11:
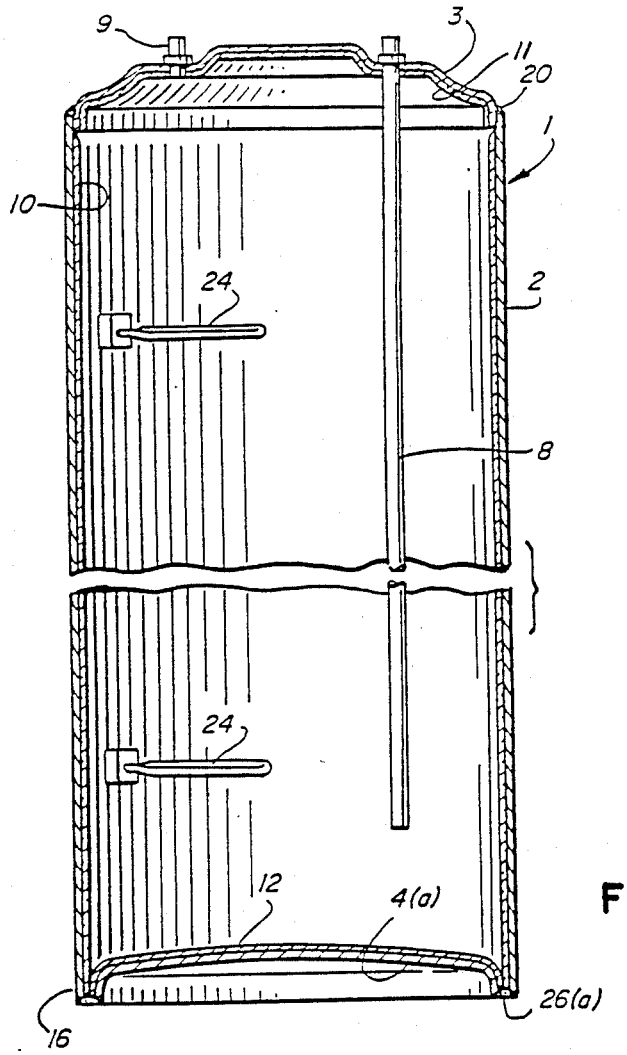
FIG. 11 is a vertical section of an electric water heater fabricated in accordance with the invention as including a glass coating on the upper head and shell and a metal coating anodic to steel on the interior surface of the lower head.
Figure 12:
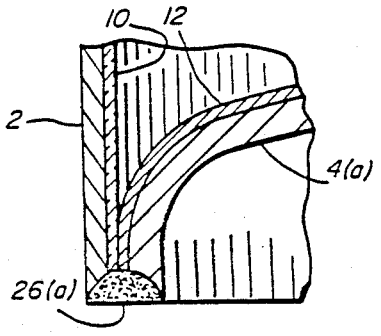
FIG. 12 is an enlarged vertical section of the welded attachment between the lower head and shell of the water heater illustrated in FIG. 11.

FIGS. 11–12 are similar to FIGS. 8–10 in terms of illustrating a water heater having interior surfaces coated with both glass and anodic metal. FIG. 11, however, illustrates an electric water heater which, as in FIG. 6, includes electric heating elements 24. The subassembly of the upper head and shell and the glass coatings 10 and 11 thereon are similar to the FIG. 8 construction. In FIGS. 11–12, the lower head **4*a* is coated with an anodic metal 12 such as aluminum. Accordingly, the aluminum coating 12 abuts the glass coating 10 on shell 2 with weld 26*a* being provided to structurally join the lower head to the shell. Weld 26*a* is in turn protected by the flow of the coating 12** material about the weld.

In the construction of the invention the conventional anode rod is eliminated, and as the anodic metal 12 is located on the central flue in the gas fired heater, it is equidistant from the inner surface of shell 2 to provide optimum protection for defects in the glass coating or metal coating as the case may be. Of course, in an electric heater, there is no flue.

It is preferred to utilize thermal spraying to apply the anodic metal coatings to the water heater components, for the sprayed coating is textured which provides an increased surface area.

While the drawings illustrate a gas fired water heater having a single central flue, it is contemplated that such a heater can have a plurality of flues that extend between the tank heads. Similarly the invention can be used with water heaters in which the burner is located within a submerged chamber in the tank as opposed to being located beneath the lower head, as illustrated.

Various modes of carrying out the invention are contemplated as being within the scope of the following claims particularly pointing out and distinctly claiming the subject matter which is regarded as the invention.

We claim:

1. A method of fabricating a water heater vessel for containing and heating water, comprising the steps of providing a steel head having a central section and an annular flange extending longitudinally from said central section, said flange terminating un a lower annular edge, said head having an inner surface to be exposed to the water, providing a steel generally cylindrical shell having an inner annular surface, applying a layer of a material resistant to corrosion by water to said inner surface of said shell, thermally spraying a coating of a metal anodic to steel on the inner surface of said head and on said flange and extending said coating substantially to said lower edge, positioning said head within the end portion of said shell with the lower edge of said flange projecting downwardly at least to the end of said shell with said surfaces disposed in lapping relation, and joining said end portion of said shell to said flange by a weld extending directly through said anodic metal coating whereby said metal coating on said head flange flows about said weld and contacts said material on said shell to hydraulically seal off said weld from contained water and provide a corrosion barrier and anodic surface to contained water at the location of said weld.

2. The method of claim 1 wherein said step of applying a layer of a material resistant to corrosion by water comprises the step of spraying aluminum to said inner surface of said shell and wherein said coating of metal on the inner surface of said head and on said flange comprises aluminum.

3. The method of claim 2 wherein said lower edge of said flange projects downwardly beyond the end portion of said shell, and said step of joining said end portion of said shell to said flange by a weld comprises placing said weld upwardly of said lower edge of said flange.

4. The method of claim 3 wherein said metal coating on said flange sufficiently extends longitudinally beyond said weld to accommodate assembly variations and the disposition of said head relative to said shell.

* * * * *